United States Patent [19]

Glover

[11] 4,140,101

[45] Feb. 20, 1979

[54] WOOD BURNING STOVE WITH FORCED AIR HEATING

[76] Inventor: Tony L. Glover, R.R. #1, Tigerton, Wis. 54486

[21] Appl. No.: 813,546

[22] Filed: Jul. 6, 1977

[51] Int. Cl.[2] ..... F24H 3/06

[52] U.S. Cl. ..... 126/110 B; 126/61; 126/66; 126/77; 126/193

[58] Field of Search ..... 126/60, 61, 63, 66, 126/67, 193, 197, 77, 112, 15 R, 110 B; 110/175 R; 292/202

[56] References Cited

U.S. PATENT DOCUMENTS

| | | | |
|---|---|---|---|
| 192,925 | 7/1877 | Lyman | 126/60 |
| 225,234 | 3/1880 | Oeth | 126/60 |
| 334,728 | 1/1886 | Ziegle | 292/202 |
| 543,742 | 7/1895 | Loy et al. | 126/61 |
| 633,715 | 9/1899 | Carter | 126/65 |
| 646,853 | 4/1900 | Loy | 126/66 |
| 1,108,513 | 8/1914 | Miller | 126/61 X |
| 2,056,507 | 10/1936 | Douglas et al. | 126/61 |

*Primary Examiner*—William E. Wayner
*Assistant Examiner*—William E. Tapolcai, Jr.
*Attorney, Agent, or Firm*—Clarence A. O'Brien; Harvey B. Jacobson

[57] ABSTRACT

A stove having an external casing provided with an opening and a cylindrical fire chamber disposed within the casing and provided with a hole arranged adjacent to and in communication with the opening of the casing. Arranged extending transversely across the cylindrical fire chamber is a grate, while a door assembly is disposed removably covering the opening provided in the external casing. Included in the door assembly is a hinged cover provided with a vent for controlling draft in the fire chamber, and with a lock which releasably secures the cover to a cowl of the door assembly on which the cover is hingedly mounted.

7 Claims, 5 Drawing Figures

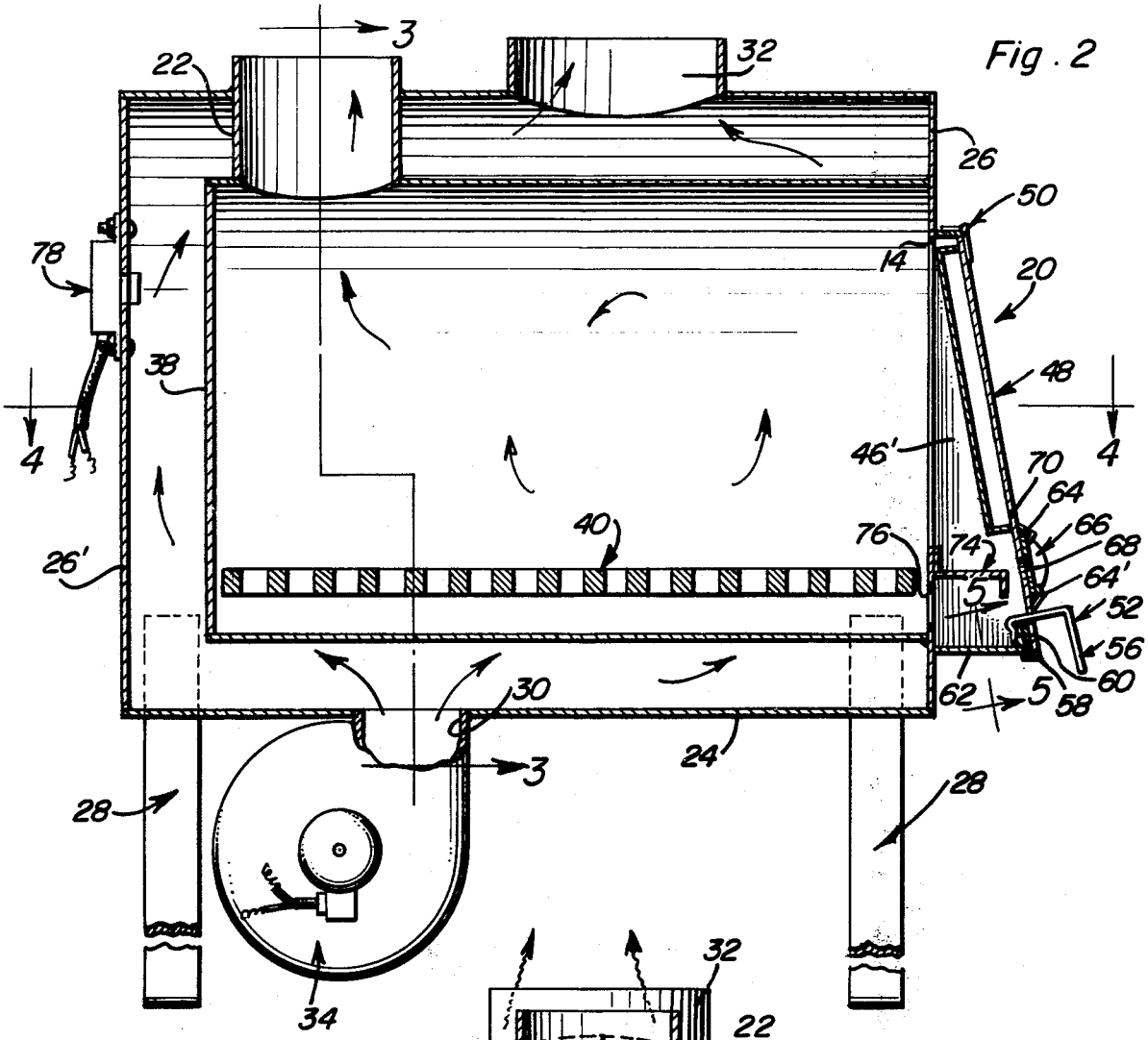
Fig. 2
3
22
32
26
50
78
14
20
38
48
4
46'
70
64
66
68
64'
52
56
60
58
62
5
76
74
40
26'
30
24
28
34
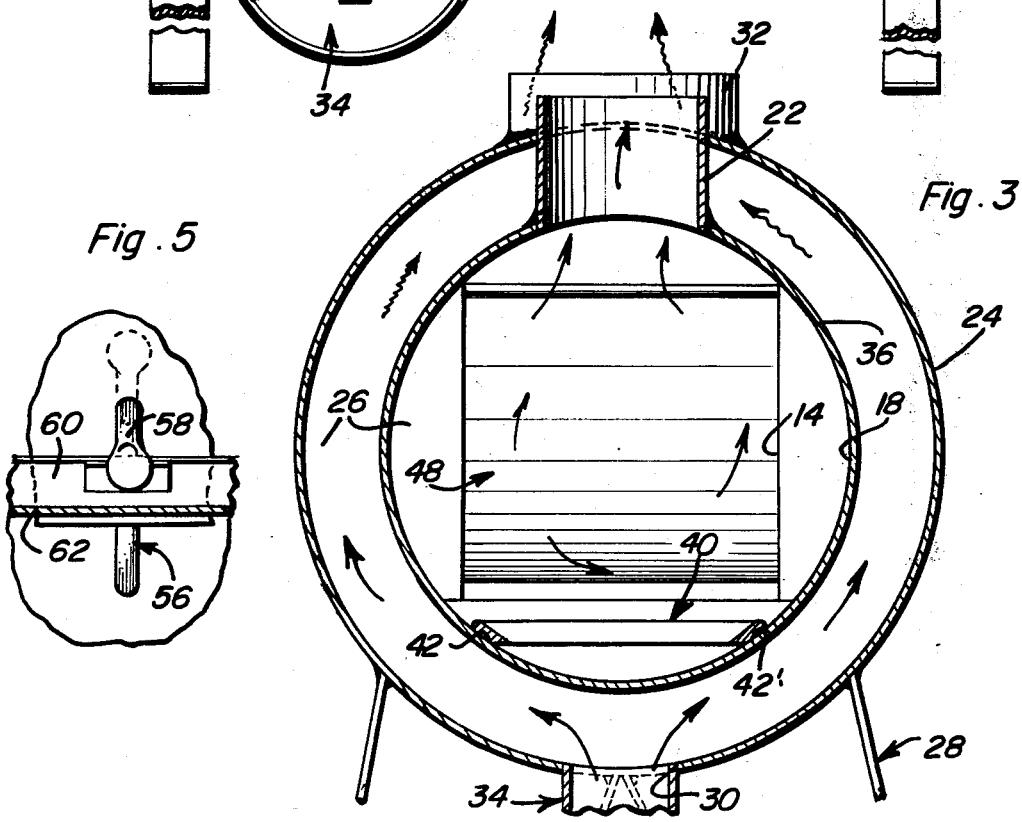
Fig. 3
32
22
24
36
26
14
18
48
40
42
42'
28
34
30
Fig. 5
60
58
62
56

WOOD BURNING STOVE WITH FORCED AIR HEATING

BACKGROUND OF THE INVENTION

1. Field of the Invention

This invention relates generally to stoves, and particularly to a stove capable of efficiently burning wood and similar materials for use in heating building space and similar purposes.

2. Description of the Prior Art

It is generally known to construct heating stoves, and the like, in the form of inner and outer chambers, with the inner chamber forming a fire chamber and the outer chamber forming a flow path passing air or other fluid to be heated over the outer surface of the fire chamber. See, for example, U.S. Pat. Nos: 89,670, issued May 5, 1869, to Lehmer; 543,750, issued July 30, 1895, to W. H. Loy, et al; and 2,810,380, issued Oct. 22, 1957, to W. L. Critten.

SUMMARY OF THE INVENTION

It is an object of the present invention to provide a wood burning stove which is more efficient in operation, yet rugged and reliable in construction.

It is another object of the present invention to provide a wood burning stove which permits for clean burning and convenient ash cleaning.

It is still another object of the present invention to provide a wood burning stove which can be easily hooked into the duct work of most existing gas and oil furnaces to be used either independently or as a supplemental heating unit.

It is a still further object of the present invention to provide a wood burning stove having a convenient and easily operated draft control.

It is yet another object of the present invention to provide a wood burning stove having a positive door latch.

A still further object of the invention is to provide a wood burning stove wherein efficient heat transfer is realized between a fluid to be heated and a fire chamber of the stove.

These and other objects are achieved according to the present invention by providing a stove having: an external casing provided with an opening; a fire chamber disposed with the casing and provided with a hole arranged adjacent to and in communication with the opening provided in the casing; a door assembly disposed removably covering the opening and the hole; and a flue pipe connected to the fire chamber and extending out of the casing for carrying combustion gases from the fire chamber.

The external casing is preferably cylindrical in shape, and includes a cylindrical side wall and substantially parallel end walls, with the opening being provided in one of the end walls. Legs are mounted on the side wall for supporting the casing, and inlet port and outlet port are provided in diametrically opposed portions of the side wall of the casing for permitting fluid flow over the fire chamber.

The fire chamber is advantageously cylindrical in shape, and includes a cylindrical main wall extending between a pair of ends. A planar wall encloses one of the ends, and the main wall is attached to the one of the end walls of the casing at the other of the ends thereof. The other of the ends of the main wall is disposed so as to form the hole, with the main wall surrounding the opening provided in the one of the end walls of the casing.

The fire chamber has a planar grate arranged extending between opposing straight lines on the main wall of the fire chamber so that the main wall curves away from the grate beneath same between the opposed straight lines. By this arrangement, ashes will fall beneath the grate and be collected in the bottom portion of the fire chamber so as to facilitate removal of the ashes from the stove.

The door assembly preferably includes a cowl mounted on the one of the end walls of the casing so as to surround the opening thereof, and extends away from the one of the end walls and from the fire chamber. A cover is pivotally mounted on the cowl at an upper portion thereof, which cowl advantageously slants outwardly away from the associated end wall of the outer casing from top to bottom. Mounted on the cover and selectively engageable with the cowl is a lock disposed for releasably securing the cover to the cowl, while a vent is provided as well on the cover for controlling draft to the fire chamber.

The lock advantageously includes a latch pivotally mounted on the cover at a point spaced from the pivotal mounting of the cover, which latch terminates at a one end in a lug which engages a ledge provided on the cowl at a location adjacent the latch. Engagement of the lug with the ledge acts to retain the cover against pivotal movement relative to the cowl.

The vent advantageously includes a slide guide, and a slide disposed in the slide guide for reciprocating movement relative thereto. Perforations are provided in the cover and slide for matching and mismatching with one another as the slide is reciprocated so as to vary the draft to the interior of the fire chamber and thus regulate the burning of a fire within the stove.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 2 is an enlarged, fragmentary, cross-sectional view taken generally along the line 2—2 of FIG. 1.

FIG. 3 is a fragmentary, cross-sectional view taken generally along the line 3—3 of FIG. 2.

FIG. 5 is an enlarged, fragmentary, cross-sectional view taken generally along the line 5—5 of FIG. 2.

DESCRIPTION OF THE PREFERRED EMBODIMENTS

Figure 1:
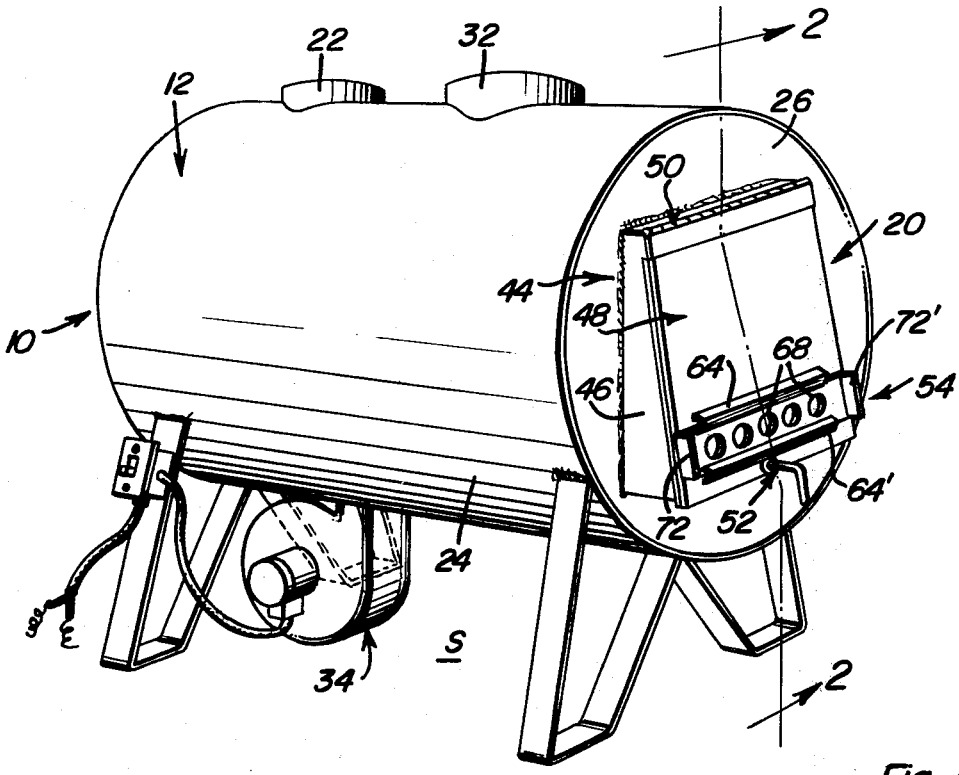
FIG. 1 is a perspective view showing a stove according to the present invention.
Figure 4:
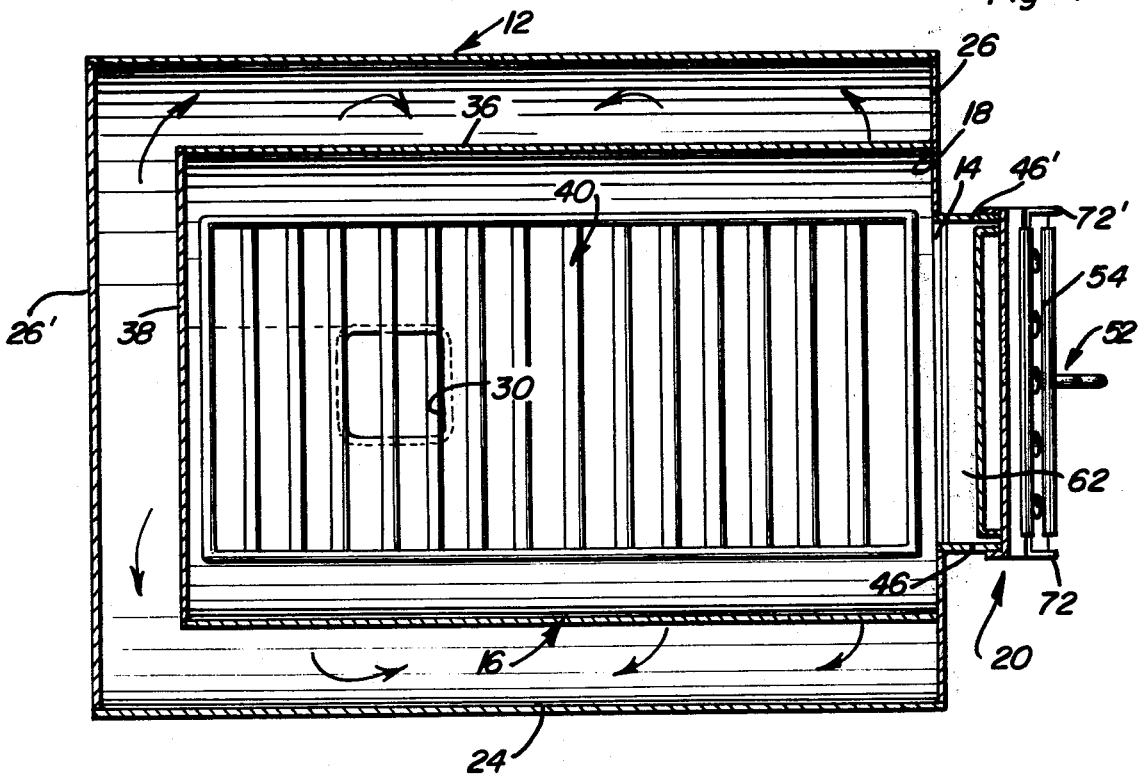
FIG. 4 is a cross-sectional view taken generally along the line 4—4 of FIG. 2.

Referring now more particularly to the figures of the drawings, a stove 10 according to the present invention, specifically intended for burning wood, and the like, includes an external casing 12 provided with an opening 14 and in which is disposed a fire chamber 16 provided with a hole 18 arranged adjacent to and in communication with opening 14. A door assembly 20 is disposed for removably covering opening 14, while a flue pipe 22 is connected to fire chamber 16 and extends upwardly out of casing 12 for carrying combustion gases away from fire chamber 16.

Casing 12 is cylindrical in shape and includes a cylindrical side wall 24 and substantially parallel end walls 26 and 26'. Opening 14 is provided in end wall 26. Legs 28 are mounted on side wall 24 for supporting casing 12 on a suitable support surface S, such as a floor, and the like, while side wall 24 is provided with an inlet port 30 and an outlet port 32 arranged in diametrically opposed portions of side wall 24 of casing 12 for permitting fluid flow over the outer periphery of fire chamber 16. A suitable blower 34, of conventional construction, is advantageously connected to inlet port 30 for creating a forced draft through casing 12 and out the outlet port 32.

Fire chamber 16 is also cylindrical in shape and includes a cylindrical main wall 36 extending between a pair of ends. A planar wall 38 encloses one of the ends, and the main wall 36 itself is attached to end wall 26 of casing 12 at the other of the ends thereof. This other end of main wall 36 is disposed so as to form the hole 18, with the main wall itself being arranged for surrounding opening 14 provided in end wall 26.

Fire chamber 16 further includes a substantially planar grate 40 constructed of a plurality of substantially parallel rails and arranged extending between opposed imaginary straight lines designated as 42 and 42' on the interior surface of main wall 36 of chamber 16. Wall 36 thus curves away from grate 40 between lines 42 so as to form a compartment beneath grate 40 for receiving ash (not shown).

The door assembly 20 includes a cowl 44 mounted on end wall 26 so as to surround opening 14 and arranged extending away from end wall 26 and from fire chamber 16. Cowl 44 includes a pair of substantially parallel, spaced, side portions 46 and 46' the outer edges of which slope outwardly away from the adjacent end wall 26 from top to bottom of stove 10, with a cover 48 being pivotally mounted on cowl 44 as by a hinge 50 attached to the upper side of cowl 44. By this arrangement, cover 48 will slant slightly outward from top to bottom. A lock 52 is mounted on cover 48 at the bottom portion thereof so as to selectively engage with cowl 44 and releasably secure cover 48 to the cowl 44. Further, a vent 54 is provided on cover 48 for controlling draft to the fire chamber 16.

Lock 52 includes a latch 56 pivotally on cover 48 at a point spaced from hinge 50 and provided with a lug 58 terminating one end of latch 56. A ledge 60 is provided on cowl 44 adjacent a base portion 62 of the cowl 44 for selective engagement by lug 58 upon rotation of latch 56 so as to retain cover 48 against pivotal movement relative to cowl 44.

As is seen in FIG. 5, a pad may be employed at the point of abutment of the terminal end of lug 58 of latch 56 with the ledge 60 so as to eliminate wear of the surface of ledge 60 at that point and also to rigidify ledge 60.

Vent 54 includes a pair of spaced, coextensive, substantially slide guides 64 and 64' of substantially inverted V-shaped cross section and slidably retaining a slide 66 against the outer surface of cover 48. Guides 64 and 64' may be affixed by one leg to cover 48 in any suitable manner. Reciprocating movement of slide 66 causes perforations 68 and 70 provided in slide 66 and cover 48, respectively, to match and mismatch in varying degrees so as to control the draft to the interior of fire chamber 16. Slide 66 is a longitudinally extending plate-like member terminating in upturned ends 72 and 72' which facilitate manipulation of slide 66, and also prevents slide 66 from being removed from the slide guides 64 and 64'.

A divider 74 is advantageously placed on the outer surface of end wall 26 so as to extend into the lower portion of cowl 44 and cause both over and under draft in order to provide better burning control within fire chamber 16. An aperture 76 is located immediately beneath divider 74 for permitting air flow to the under portion of grate 40.

A conventional thermostatic unit 78 is provided for controlling the operation of blower 34.

As can be readily understood from the above description and from the drawings, a stove according to the present invention provides a particularly efficient wood burning device. The location of the blower at the bottom and near the back of the stove creates a flow path of reduced resistance, with back pressure on the blower being virtually eliminated, and resulting in better circulation of the air or other fluid to be heated due to the relative location of the hot air stack or outlet port in the upper front portion of the stove. The over-all air circulation arrangement provides greater heat and maintains a more even temperature in casing 12 than is realized with conventional arrangements. While the spacing between side wall 24 and main wall 36 can vary, a distance of three inches (7.8 centimeters) between the two walls has been found satisfactory. The location of the grating in the bottom of the cylindrical fire box and the unique door assembly featuring positive locking and convenient dampening also contribute to the efficiency of the invention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A stove, comprising, in combination:

(a) an external casing provided with an opening;

(b) a fire chamber disposed within the casing and provided with a hole arranged adjacent to and in communication with the opening provided in the casing, the fire chamber including a planar grate arranged extending between side walls of the casing;

(c) door means disposed removably covering the opening; and (d) a flue pipe connected to the fire chamber and extending out of the casing for carrying combustion gases from the fire chamber, the door means including, in combination:

(1) a cowl mounted on the casing and surrounding the opening provided in the casing, the cowl arranged extending away from both the casing and the fire chamber;

(2) a cover pivotally mounted on the cowl;

(3) lock means mounted on the cover and selectively engageable with the cowl for releasably securing the cover to the cowl; and (4) vent means provided on the cover for controlling draft to the fire chamber, the vent means including a slide guide, a slide disposed in the slide guide for reciprocating movement relative thereto, perforations being provided in the cover and slide for matching and mismatching with one another, and a divider placed on the casing and disposed extending into the cowl substantially coplanar with the grate, the divider being arranged bisecting the perforations and causing both over and under draft in order to provide better burning control with the fire chamber.

2. A structure as defined in claim 1, wherein the external casing is cylindrical in shape and includes a cylindrical side wall and substantially parallel end walls, the opening being provided in one of the end walls, legs mounted on the side wall supporting the casing on a suitable support surface, and an inlet port and an outlet port provided in diametrically opposed portions of the side wall of the casing for creating a fluid flow path over the fire chamber.

3. A structure as defined in claim 2, wherein the fire chamber is cylindrical in shape and includes a cylindrical main wall extending between a pair of ends, a planar wall enclosing one of the ends, and the main wall attached to the one of the end walls of the casing at the other of the ends of the main wall, the other of the ends of the main wall being disposed forming the hole, and the main wall being arranged surrounding the opening provided in the one of the end walls of the casing.

4. A structure as defined in claim 3, wherein the planar grate is arranged extending between opposed straight lines on the main wall of the fire chamber, the main wall being curved away from the grate between the opposed straight lines for forming an ash receiving chamber beneath the grate.

5. A structure as defined in claim 1, wherein the fire chamber is cylindrical in shape and includes a cylindrical main wall extending between a pair of ends, a planar wall enclosing one of the ends, and the main wall being attached to the casing at the other of the ends of the main wall, the other of the ends of the main wall being disposed forming the hole of the fire chamber, and the main wall disposed surrounding the opening provided in the casing.

6. A structure as defined in claim 5, wherein the planar grate is arranged extending between opposed straight lines on the main wall of the fire chamber, the main wall being curved away from the grate between the opposed straight lines for forming an ash receiving chamber beneath the grate.

7. A structure as defined in claim 1, wherein the lock means includes a latch pivotally mounted on the cover at a point spaced from the pivotal mounting of the cover on the cowl, the latch provided with a terminal lug, and a ledge provided on the cowl adjacent the latch, the lug engaging the ledge to retain the cover against pivotal movement relative to the cowl.

* * * * *